US008991377B2

(12) United States Patent
Jorgens et al.

(10) Patent No.: US 8,991,377 B2
(45) Date of Patent: Mar. 31, 2015

(54) BUCKET FEEDER FOR A BALL PROJECTING MACHINE

(71) Applicant: Wilson Sporting Goods Co., Chicago, IL (US)

(72) Inventors: David A. Jorgens, Truckee, CA (US); Timothy D. Greene, Reno, NV (US); Jose L. Lopez, Reno, NV (US)

(73) Assignee: Wilson Sporting Goods Co., Chicago, IL (US)

( * ) Notice: Subject to any disclaimer, the term of this patent is extended or adjusted under 35 U.S.C. 154(b) by 72 days.

(21) Appl. No.: 13/835,192

(22) Filed: Mar. 15, 2013

(65) Prior Publication Data

US 2014/0274485 A1 Sep. 18, 2014

(51) Int. Cl.
*F41B 4/00* (2006.01)
*A63B 69/40* (2006.01)

(52) U.S. Cl.
CPC ..... *A63B 69/406* (2013.01)
USPC ..... 124/51.1

(58) Field of Classification Search
USPC ..... 124/45, 48, 49, 51.1, 52
See application file for complete search history.

(56) References Cited

U.S. PATENT DOCUMENTS

| | | | | |
|---|---|---|---|---|
| 2,792,822 | A | 5/1957 | Ponza | 124/7 |
| 4,195,614 | A | 4/1980 | Ponza | 124/1 |
| 4,502,455 | A | 3/1985 | Stokes | 124/50 |
| 4,676,504 | A | 6/1987 | Ponza | 273/26 |
| 4,823,763 | A | 4/1989 | Ponza | 124/78 |
| 4,896,646 | A | 1/1990 | Kahelin et al. | 124/51 |
| 5,097,985 | A * | 3/1992 | Jones | 221/86 |
| 5,257,615 | A * | 11/1993 | Jones | 124/56 |
| D356,842 | S | 3/1995 | Trapp | D21/210 |
| 5,437,261 | A | 8/1995 | Paulson et al. | 124/78 |
| 5,832,909 | A | 11/1998 | Grant et al. | 124/6 |
| 6,089,217 | A | 7/2000 | Paulson et al. | 124/78 |
| 6,164,271 | A | 12/2000 | Paulson et al. | 124/78 |
| 6,176,230 | B1 | 1/2001 | Thompson | 124/16 |
| 6,190,271 | B1 | 2/2001 | Rappaport et al. | 473/451 |
| 6,440,003 | B1 | 8/2002 | Phillips et al. | 473/137 |
| 6,508,384 | B1 | 1/2003 | Tien et al. | 221/289 |
| 6,644,293 | B2 * | 11/2003 | Jong | 124/52 |
| 6,729,321 | B2 | 5/2004 | Ho | 124/49 |
| 6,739,325 | B1 | 5/2004 | Paulson | 124/78 |
| 6,923,170 | B2 | 8/2005 | Ho et al. | 124/49 |
| 6,974,396 | B2 * | 12/2005 | Mauer et al. | 473/417 |
| 7,231,913 | B2 | 6/2007 | Wilson | 124/78 |
| 7,350,515 | B2 | 4/2008 | Yao et al. | 124/51.1 |
| 8,074,633 | B2 | 12/2011 | Grant et al. | 124/78 |
| 2006/0130822 | A1 * | 6/2006 | Jong | 124/51.1 |

* cited by examiner

*Primary Examiner* — John Ricci
(74) *Attorney, Agent, or Firm* — Terence P. O'Brien

(57) ABSTRACT

A ball feeder assembly for a ball projecting machine includes a stand, an upper frame, a ball delivery element coupled to the frame, and a ball feeder member coupled to the ball delivery element. The assembly is configured for supporting a cylindrical ball bucket. The frame is movably coupled to the stand between at least a first position in which the frame is configured to support the bucket in a position with a top end at a higher elevation than a bottom end such that the longitudinal axis of the bucket is at angle within 0 and 80 degrees from a vertical plane, and a second position in which the frame is configured to support the bucket in a downward position with the bottom end at a higher elevation than the upper end such that the axis is within 5 to 90 degrees with respect to a horizontal plane.

22 Claims, 7 Drawing Sheets

BUCKET FEEDER FOR A BALL PROJECTING MACHINE

FIELD OF THE INVENTION

The present invention relates to a ball feeder for a ball projecting machine configured for use with a ball bucket.

BACKGROUND OF THE INVENTION

Pitching machines are widely used by both professional and non-professional athletes for batting practice. Conventional pitching machines include a pitching head having either one motor driven wheel or two counter-rotating motor driven wheels that engage a ball and project the ball toward an awaiting batter. Pitching machines enable a coach, players or a team to project balls, such as baseballs or softballs to players repeatedly for a single batter or multiple batters. The pitching machines simulate a pitched ball and typically the speed of the pitch can be adjusted to match the desired need of the player, team or coach. The pitching machine saves the coach or other player from having to throw pitches at the desired location and speed over and over again. Pitching machines enable a player, team or coach to focus on a particular hitting skill or multiple hitting skills. Ball projecting machines can also be used to simulate batted balls, such as ground balls, infield pop-ups, flyballs, line drives, etc.

Pitching machines are such an effective tool for baseball or softball practice that many users find a limitation of the machine to be the collection and reloading of baseballs or softballs into the machine. Teams often collect baseballs and softballs from the field or their storage area in ball buckets that typically hold up to approximately 60 balls. Existing ball projecting or pitching machines have some drawbacks when it comes to ball loading. Some pitching machines have no ball load or feed system and require a coach or other user to manually feed balls into the pitching machine one at a time to the batter. Other pitching machines have very small ball feeders that hold very few balls and, in some instances, have designs that enable the balls to be readily dislodged from the ball feeders resulting in practice balls dropping to the ground around the pitching machine. Other existing ball projecting machines can include large ball feeding tube assemblies that must be filled one ball at a time by the user. Typically, the team, player or coach will manually retrieve one or two balls from the ball bucket and place them into either the ball feeder assembly or directly into the ball projecting machine. Such repeated manual filling of such ball feeders can become tedious or burdensome to many users. Other more expensive pitching machines can include very large hoppers for storing a hundred or more balls. Such machines are usually quite large and are difficult to maneuver about the practice area or field, particularly when they are filled with balls. Such ball hopper systems can be impractical because very few coaches, players or teams want to shag one hundred or more balls at one time, and some teams don't have a hundred or more usable balls.

Accordingly, a need exists for a more efficient way to provide balls to a ball projecting machine. It would thus be desirable to provide an assembly that enables a player, team or coach to easily load or feed practice balls into a pitching machine or ball projecting machine. It would be advantageous to provide a ball feeding system that did not require manual loading of balls into a ball feeder. What is needed is a ball feeding system that is simple, cost effective and works well with existing equipment. It would be desirable to provide a ball feeding system that is not too small or too large, and prevents the balls from being readily dislodged from the ball feeder.

SUMMARY OF THE INVENTION

The present invention provides a ball feeder assembly for a ball projecting machine includes a frame, a ball delivery element, a motor, and a ball feed member. The ball feeder assembly is configured for supporting a cylindrical bucket having top and bottom end and at least a pair of annular projections adjacent the top end. The bucket is configured for holding a plurality of balls. The frame includes a bucket support arm having first and second spaced-apart bucket supports. The first support is configured to removably engage the bucket between the pair of annular projections. The motor is supported by the frame and is operably coupled to the ball delivery element. The ball feed member is coupled to the ball delivery element. The ball feed member has a first end coupled to the ball feeder assembly and a second end removably coupled to the ball projecting machine.

According to a principal aspect of a preferred form of the invention, a ball feeder assembly for a ball projecting machine includes a stand, an upper frame, a ball delivery element coupled to the upper frame, and a ball feeder member coupled to the ball delivery element. The ball feeder assembly is configured for supporting a cylindrical ball bucket containing a plurality of balls. The bucket longitudinally extends from a closed bottom end to an open top end along a longitudinal axis. The upper frame is movably coupled to the stand between at least a first bucket loading position in which the upper frame is configured to support the bucket in a generally upright position with the upper top end at a higher elevation than the bottom end such that the longitudinal axis of the bucket is at angle within the range of between 0 and 80 degrees from a vertical plane, and a ball feed position in which the upper frame is configured to support the bucket in a downward position with the bottom end at a higher elevation than the upper end such that the longitudinal axis is within the range of 5 to 90 degrees with respect to a horizontal plane.

According to another principal aspect of a preferred form of the invention, a ball feeder assembly is configured to deliver a plurality of balls to a ball projecting machine, and includes a stand, an upper frame movably coupled to the stand, a first adjustment mechanism, a cylindrical ball bucket, a ball delivery element, and a ball feed member coupled to the ball delivery element. The first adjustment mechanism is coupled to at least one of the stand and the upper frame. The first adjustment mechanism includes a first adjusting element that, when repositioned, incrementally rotates the upper frame about the first pivot axis. The cylindrical ball bucket is removably coupled to the upper frame. The bucket longitudinally extends from a closed bottom end to an open top end along a longitudinal axis, and includes at least two spaced apart annular projections adjacent the open top end. The ball delivery element includes a ball receiving surface and defining at least one outlet aperture.

This invention will become more fully understood from the following detailed description, taken in conjunction with the accompanying drawings described herein below, and wherein like reference numerals refer to like parts.

DETAILED DESCRIPTION OF THE INVENTION

Figure 1:
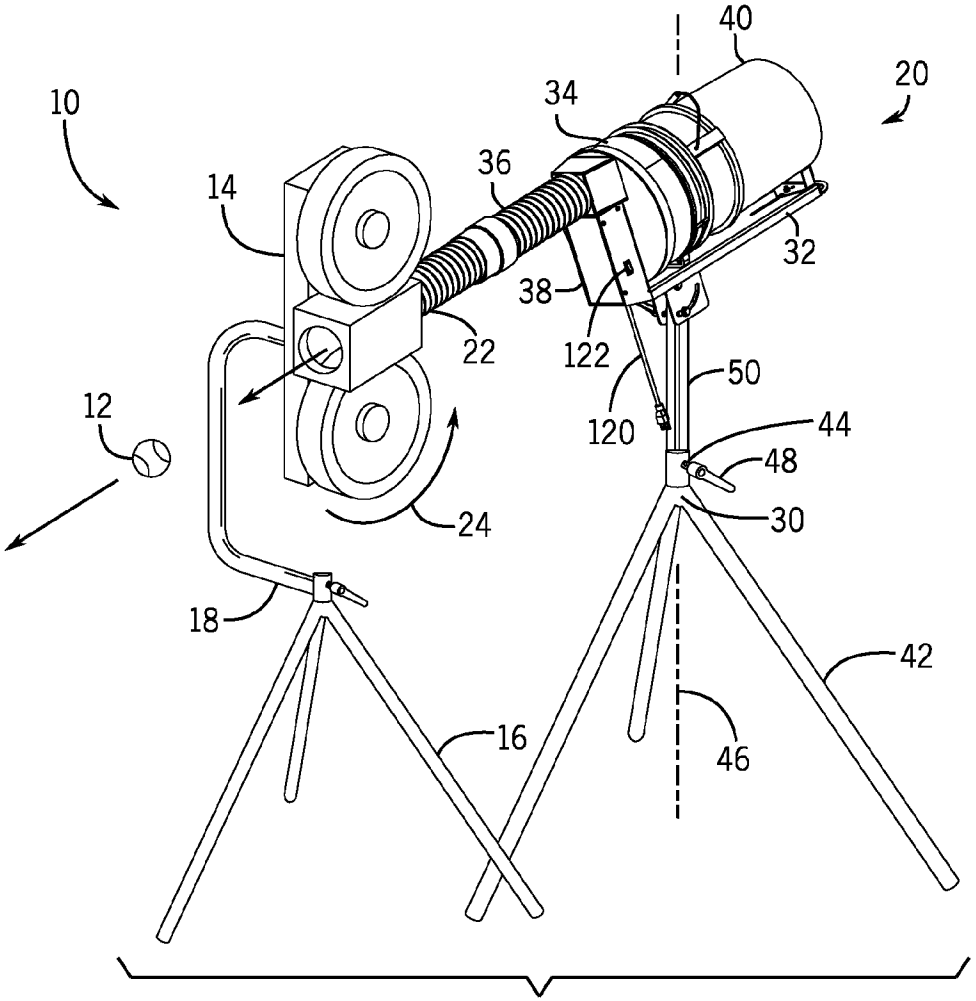
FIG. 1 is a side perspective view of a pitching machine and a bucket ball feeder assembly in accordance with a preferred embodiment of the present invention.

Referring to FIG. 1, a pitching machine configured for projecting or pitching a ball 12 is indicated generally at 10 in conjunction with a bucket ball feeder assembly 20. The present invention is described below with respect to a pitched baseball or softball. The present invention is also applicable to ball projecting machines and ball feeder assemblies of baseballs or softballs for other purposes, such as to replicate fly balls, line drives, ground balls and/or other projected ball paths. Further, the present invention is also applicable to other types of balls, such as, for example, Japanese rubber balls, tennis balls and lacrosse balls.

The pitching machine 10 is one representation of a ball projecting machine. The pitching machine includes a pitching head 14 situated atop of, and coupled to, a pitching stand 16 through a support arm 18. The pitching machine 10 includes a ball inlet 22 and a ball projecting region 24 for projecting the ball 12 from the pitching machine 10. The ball feeder assembly 20 is configured for use with other types of pitching machines and ball projecting machines.

Figure 2:
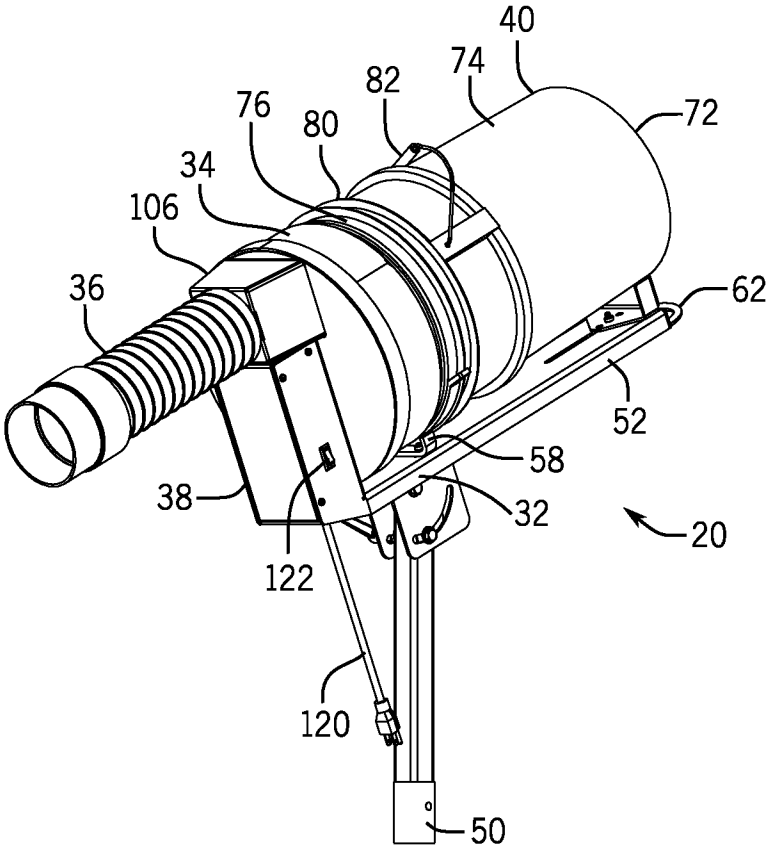
FIG. 2 is front, second side perspective view of the bucket ball feeder assembly of FIG. 1 with a bucket mounted to the assembly.
Figure 4:
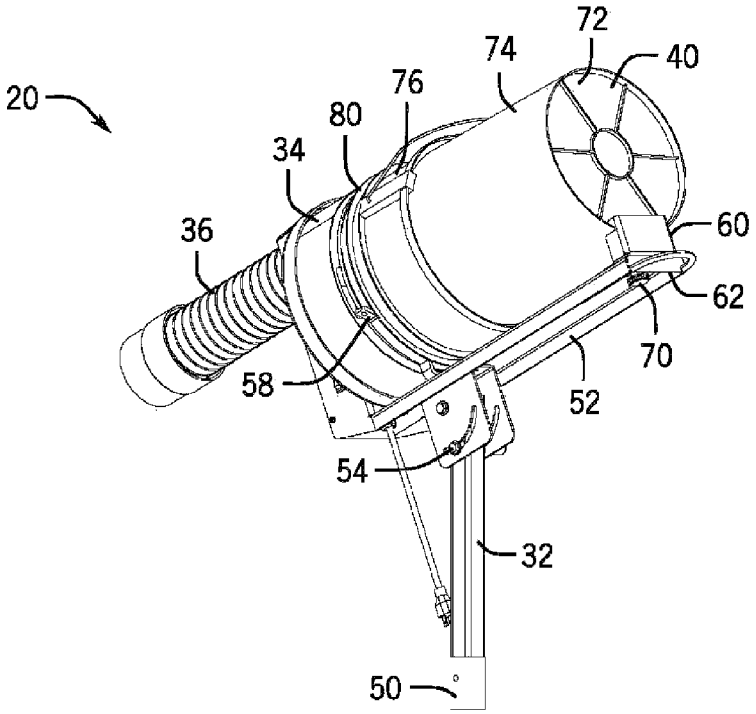
FIG. 4 is a rear, side perspective view of the bucket ball feeder assembly of FIG. 1 with a bucket mounted to the assembly.
Figure 5:
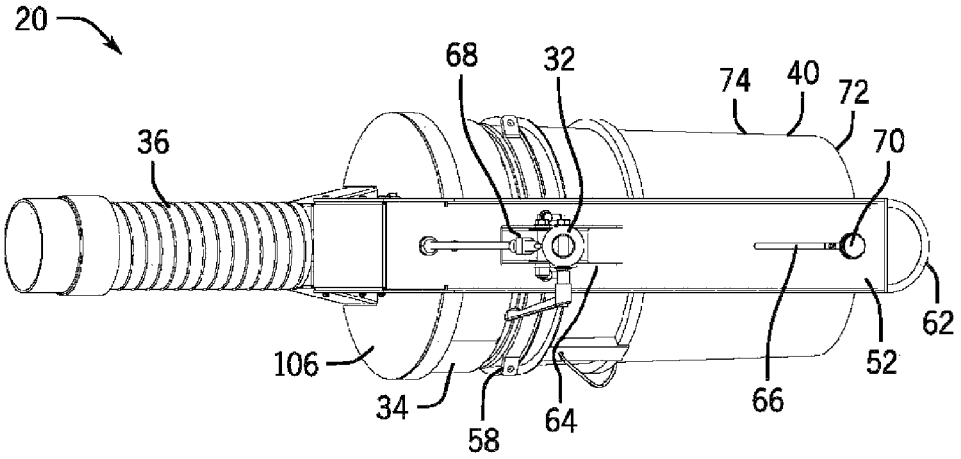
FIG. 5 is a bottom view of the bucket ball feeder assembly of FIG. 1 with a bucket mounted to the assembly.

Referring to FIGS. 1 and 2, the bucket ball feeder assembly 20 includes a stand 30, a frame 32, a ball delivery element 34, a ball feed member 36 and a drive assembly 38. The bucket feeder assembly 20 removably supports a ball bucket 40, and is configured for providing a plurality of balls 12 to the pitching machine 10.

The stand 30 is a rigid support structure configured to support the ball feeder assembly 20 on a generally horizontal surface such as a ball field, an indoor practice facility, a pitcher's mound or other practice location. The stand 30 is configured to maintain the bucket ball feeder in an operable position and inhibit the ball feeder assembly 20 from tipping over upon incidental contact with a user. The stand 30 can be formed as a tripod having three rigid legs 42 for supporting the ball feeder 10. The legs can have a fixed length or can be adjustable in length. The legs 42 can be integrally or non-separable connected to the rest of the stand 30. In another implementation, the legs 42 can be removably attached to the rest of the stand 30. In another implementation, the stand can have two, four or more legs. In another implementation, the stand can include an enlarged base for supporting the ball feeder. In another implementation, the stand can be configured to be driven into the ground for support, like a stake. In another implementation, the ball feeder assembly 20 can have no stand or have the stand removed, and the feeder assembly 20 can be coupled to the pitching machine 10 and supported by the stand of the pitching machine 10. In another implementation, the stand can be configured to support the ball feeder assembly on a raised structure such as a table. In another implementation, the stand can be configured to attach to another rigid support structure such as a batting cage or pitching fence frame.

The stand 30 is coupled to the upper frame 32. In one implementation, the stand 30 is movably coupled to the upper frame 32 by at least one axis. A first adjusting mechanism 44 can be used to movably couple the stand 30 to the upper frame 32 such that the upper frame 32 is repositionable about a vertical axis 46 as desired by the user. The first adjusting mechanism 44 can include a first locking handle 48. In other implementations, other forms of adjusting mechanisms can be used that provide repositioning of the upper frame with respect to the stand in at least two different orientations or positions about the vertical axis.

The upper frame 32 can include a lower post member 50 that movably engages the stand 30. The relative lengths of the stand 30 and the post member 50 can be varied to provide the desired height for the first adjusting mechanism 44. The stand 30 can be removable from the post member 50 to facilitate relocation or transporting of the feeder assembly 20. The stand 30 is preferably formed of a rigid, durable material, such as steel. In alternative embodiments, the stand can be formed of other materials, such as, for example, aluminum, other alloys, fiber composite materials, a plastic, other polymeric materials, a ceramic, wood, and combinations thereof.

Referring to FIGS. 2 through 5, the upper frame 32 is shown in greater detail. The upper frame includes the lower post member 50 and a bucket support aim 52. The bucket support arm 52 is a rigid elongate member. The bucket support arm 52 can be fixedly and rigidly connected to the post member 50. In another implementation, the bucket support arm 52 can be movably connected to the post member 50 by a second adjusting mechanism 54. The bucket support arm 52 is configured to removably or releasably support the bucket 40. The support arm 52 supports the ball delivery element 34, the ball feed member 36, the drive assembly 38, and first and second bucket supports 58 and 60. The upper frame 32 is preferably formed of a rigid, durable material, such as steel. In alternative embodiments, the stand can be formed of other materials, such as, for example, aluminum, other alloys, fiber composite materials, a plastic, other polymeric materials, a ceramic, wood, and combinations thereof. The support arm 52 can further include a handle 62 for facilitating the transport of the feeder assembly 20 and the repositioning of the upper frame 32 with respect to the stand 30, and/or repositioning of the support arm 52 with respect to the post member 50 and the stand 30.

The bucket support arm 52 is configured to support the bucket 40. The bucket 40 is a conventional ball bucket, and is can also be referred to as a utility bucket or a paint bucket or a soil bucket. The bucket 40 is cylindrical and includes a closed bottom end 72, a side wall 74 and an open top end 76. The bucket 40 has a cylindrical shape that extends along a longitudinal axis of the bucket from the closed bottom end 72 to the open top end 76. The bucket 40 can have a generally circular transverse cross-sectional area, and the cylindrical bucket can be tapered such that the diameter of the bucket at the bottom end 72 can be smaller than the diameter of the bucket at the top end 76. The side wall 74 can include at least one annular projection generally positioned adjacent or near the top end 76. In other configurations, the bucket 40 includes two or more longitudinally spaced apart annular projections 80. The bucket 40 is typically formed of a durable material such as a high density polyethylene. The bucket can be formed of other durable materials, such as, other plastic materials, ABS, other polymeric materials, metal, wood, or combinations thereof. The bucket 40 can also include a handle 82. The bucket 40 is sized to carry a plurality of balls 12. In one implementation, the bucket 40 has a 5 gallon capacity, and can hold and retain approximately 60 balls. The bucket can have a diameter at its top end 76 of approximately 12 inches, a diameter at its lower end of approximately 10 inches, and a height of approximately 14 inches. In other implementations, the bucket can have other diameters, heights, and tapers. The bucket can be formed in other volumes such as 6 gallons, 4 gallons, 3 gallons, and other sizes.

The bucket 40 is removably attachable to the feeder assembly 20. The bucket 40 can be sold or grouped with the feeder assembly 20, or it can be supplied separately by a user. The feeder assembly 20 can accommodate a variety of different shaped buckets of different sizes.

The first and second bucket supports 58 and 60 of the bucket support arm 52 are spaced apart from each other to provide proper support for the bucket 40. The support arm 52 can include first and second slot arrangements 64 and 66 and associated first and second fasteners 68 and 70 for adjusting the positioning of the first and second bucket supports 58 and 60 along the support arm 52, respectively. In one implementation, the first bucket support 58 can be a cradle-type support that has an arcuate shape for engaging the side wall 74 of the bucket 40, preferably between two of the annular projections 80. The second support 60 can be configured to engage the bottom end 72 of the bucket. The second support 60 can include at least one notch 84 for engaging the bottom end 72. The first and second supports 58 and 60 support the side wall 74 and the bottom end 72 of the bucket 40. The first support 58 preferably has a width of approximately 0.75 inch to engage the side wall 74 between the projections 80 and support the bucket 40 laterally and longitudinally. The first support 58 serves as a stop that prevents the bucket 40 from sliding into contact with the ball delivery element 34. The first and second slot arrangements 64 and 66 and the first and second fasteners 68 and 70 enable the user to quickly adjust the feeder assembly 20 to accommodate buckets 40 of many different shapes and sizes. In other implementations, the first and second supports can have other shapes that engage the bucket.

Figure 6:
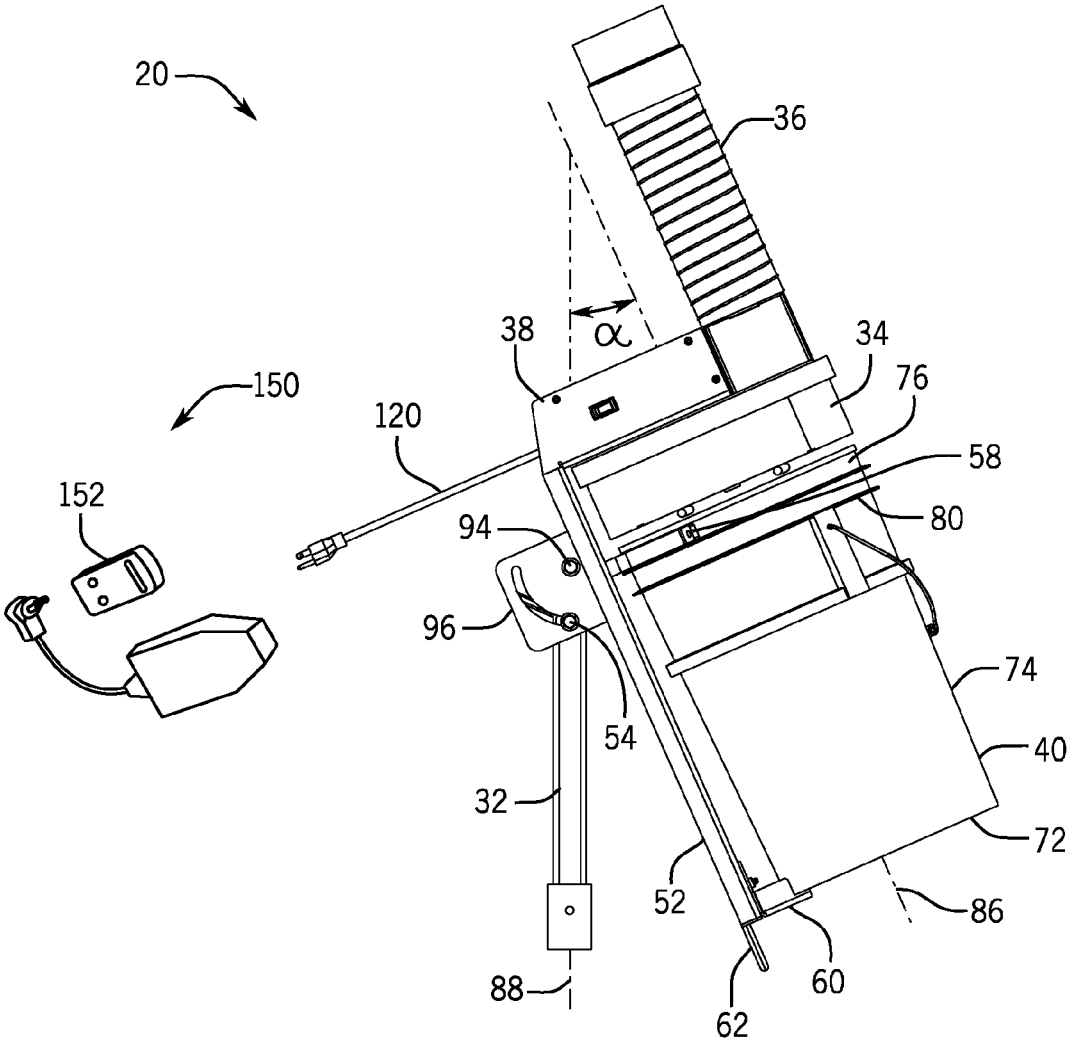
FIG. 6 is a side view of the bucket ball feeder assembly of FIG. 1 shown in a first bucket loading position.
Figure 7:
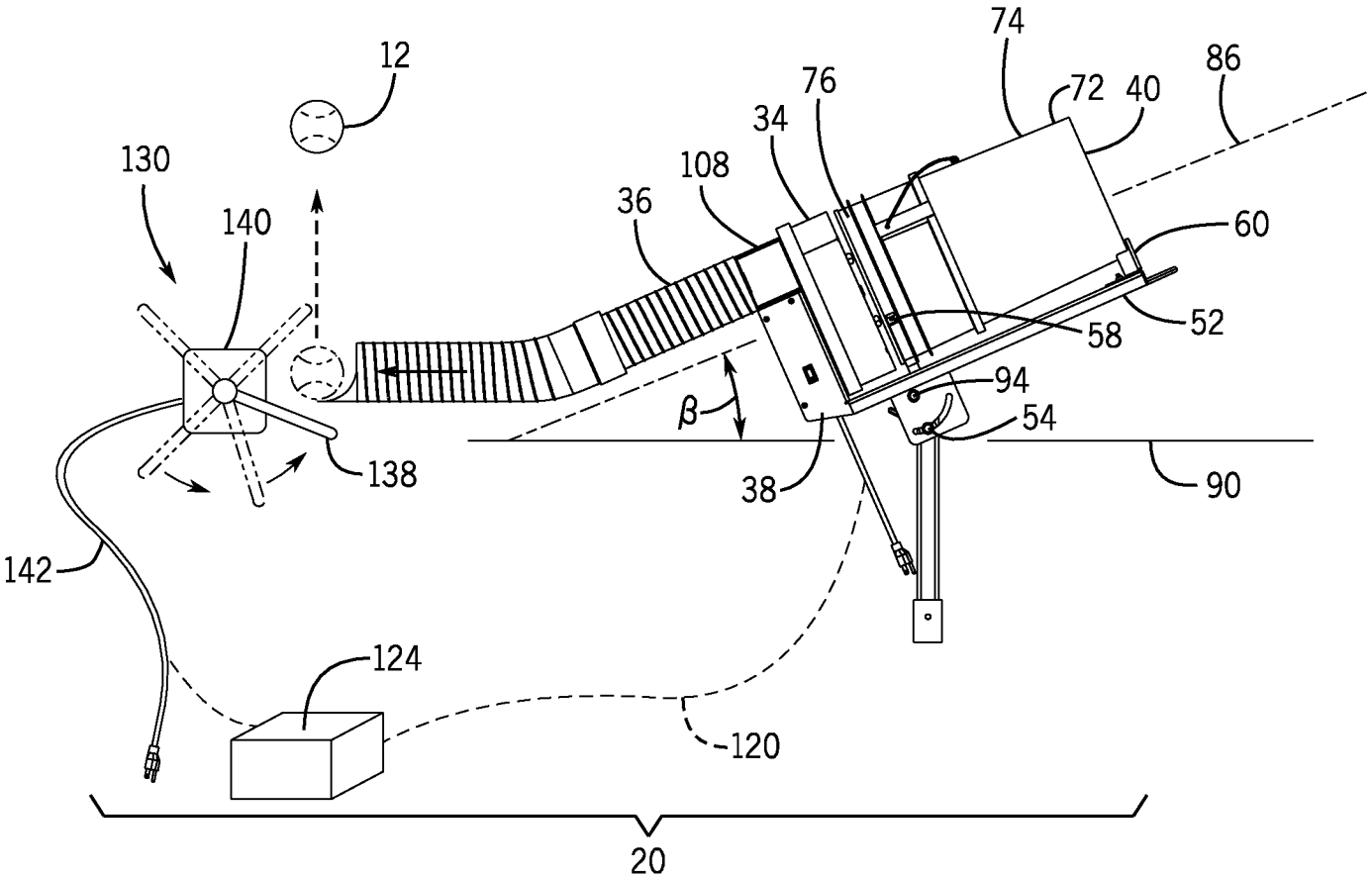
FIG. 7 is a side view of the bucket ball feeder assembly of FIG. 1 shown in a second ball feed position.

Referring to FIGS. 6 and 7, the bucket support arm 52 of the upper frame 32 is movably coupled to, and positionable relative to, the stand 30 through the second adjusting mechanism 54. The second adjusting mechanism 54 enables the pivotal movement of the support aim 52 relative to the stand 30 about a second axis 94. In one implementation, the support arm 52 of the upper frame 30 is movable relative to the stand 30 between at least a first bucket loading position in which the upper frame 32 is configured to support the bucket 40 in a generally upright position with the top end 76 at a higher elevation than the bottom end 72 such that a longitudinal axis 86 of the bucket 40 is at a first angle, a, within the range of between 0 and 80 degrees from a vertical plane 88, and a second ball feed position in which the upper frame 32 is configured to support the bucket 40 in a downward position with the bottom end 72 at a higher elevation than the upper end 76 such that the longitudinal axis 86 is at a second angle, within the range of 5 to 90 degrees with respect to a horizontal plane 90. In one preferred implementation, the first angle $\alpha$ of the first bucket loading position is within the range of 0 to 45 degrees with respect to the vertical plane 88. In another preferred implementation, the second angle $\beta$ of the ball feed position is within the range of 10 to 60 degrees with respect to the horizontal plane 90. The second adjusting mechanism 54 includes a second locking handle 96 (also shown on FIG. 10) for releasably securing the second adjusting mechanism 54 and the support arm 52 in the desired position with respect to the stand 30 or the vertical plane 88.

In another implementation, the ball feeder assembly can include a third adjusting mechanism that enables the ball feeder assembly to be moved or positioned relative to a third axis. The third axis can be perpendicular to both the first and second axes 46 and 94.

In the first bucket loading position as shown in FIG. 6, the bucket 40 can be readily positioned onto the support arm 52 for subsequent use with the pitching machine 10. The first and second supports 58 and 60 can be adjusted as necessary to accommodate and support the bucket 40. The first support 58 serves as a stop to prevent the bucket 40 from impacting or rubbing against the ball delivery element 34. The first bucket loading position enables the bucket 40, which is typically filled with balls, to be loaded onto the feeder assembly 20 without the balls spilling or dropping from the open end 76 of the bucket 40.

Referring to FIG. 7, in the second ball feed position, the support arm 52 is positioned to tilt the bucket 40 such that the open end 76 is at an elevation that is less than the bottom end 72 such that the balls bear against the ball delivery element 34 by virtue of gravity. The handle 62 can be used to facilitate the repositioning of the support arm 52 with respect to the stand 30 between the first and second positions. In other implementations, other angular positions of the support arm can also be used.

Figure 3:
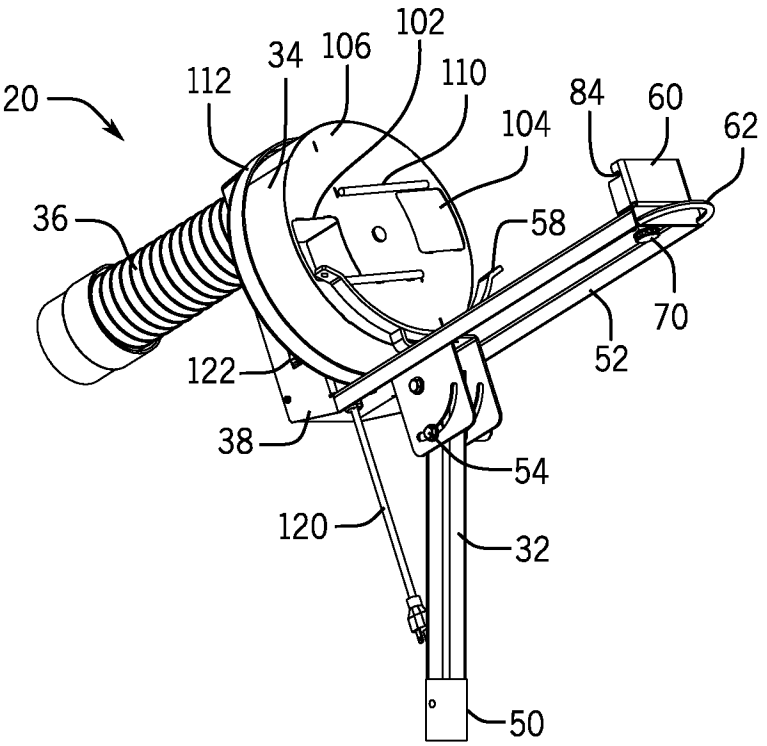
FIG. 3 is a side perspective view of the bucket ball feeder assembly of FIG. 1 shown without a bucket mounted to the assembly.
Figure 8:
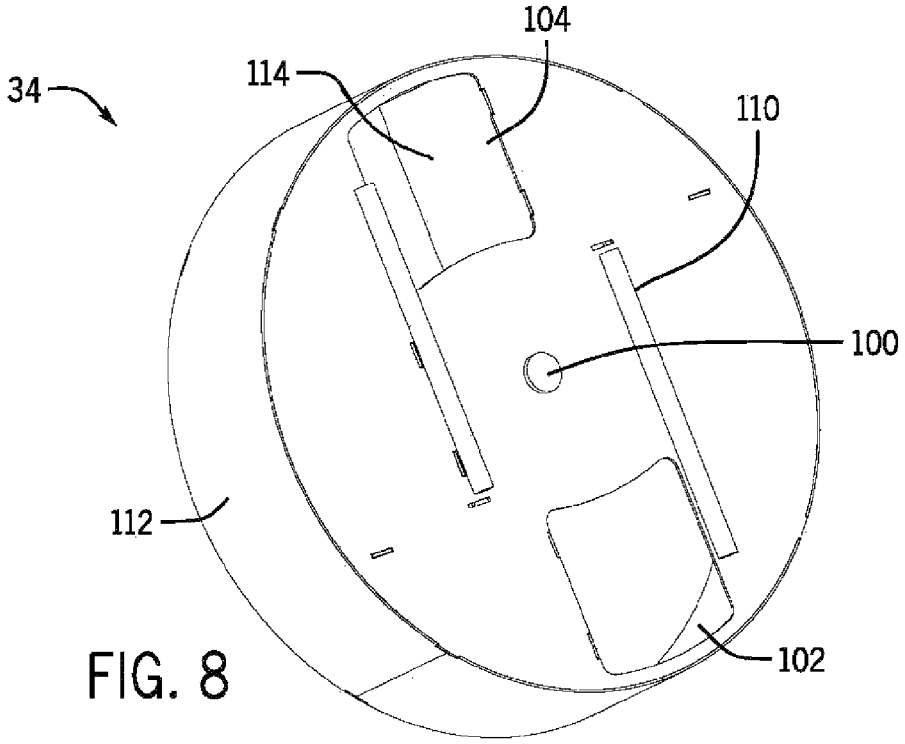
FIG. 8 is a side perspective view of a rotatable ball delivery element of the ball feeder assembly of FIG. 1.
Figure 9:
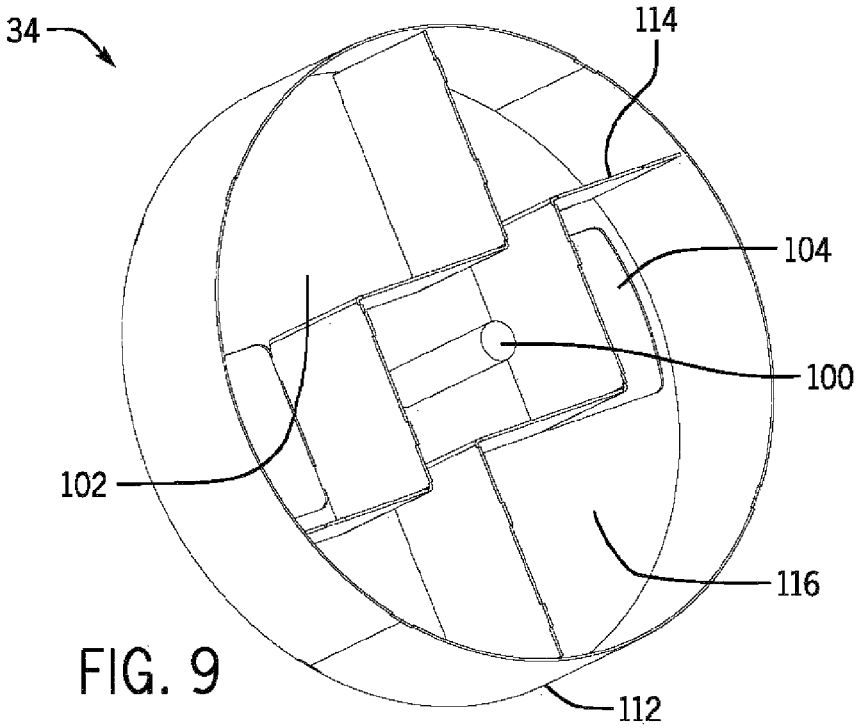
FIG. 9 is a side perspective view of the rotatable ball delivery element of FIG. 8 shown without a rear ball feed surface.

Referring to FIGS. 3, 8 and 9, the ball delivery element 34 is shown in greater detail. In one implementation, the ball delivery element 34 is a drum that is rotatable about a central shaft 100. The ball delivery element 34 includes a ball receiving wall or surface 102 defining at least one ball inlet aperture 104, and a ball feed wall or surface 106 defining at least one ball outlet aperture 108. In one implementation, the ball receiving surface 102 defines two radially spaced apart inlet apertures 104. In another implementation, the ball receiving surface 102 includes at least one ball agitator 110 projecting outwardly from the surface 102. In one implementation, the surface 102 includes two spaced apart ball agitators 110. The ball receiving surface 102 the ball feed surface 106 are spaced apart by a delivery element side wall 112 and at least one dividing wall 114. The side wall 112, the dividing walls 114 and the surfaces 102 and 106 define at least one ball retention cavity 116.

During use, the bucket 40 is loaded onto the feeder assembly 20 in the second ball feed position. The balls within the bucket 40 bear against the ball receiving surface 102. As the ball delivery element 34 rotates about the shaft 100, the agitator 110 facilitates the movement and loading of the balls and as the ball inlet aperture 104 moves next to one of the balls, the ball drops into the ball retention cavity 116 of the ball delivery element 34. The ball inlet aperture 104 is advantageously sized to permit enable one ball to fit through the aperture 104 at a time. The depth of the ball delivery element 34 and its rotation speed are configured to allow for one ball to enter the ball retention cavity 116 at any instance. In other implementations, other configurations of the ball delivery element 34 can be used to allow for two, three or more balls to enter the ball retention cavity of the ball delivery element at the same time. As the ball delivery element 34 continues to rotate, the ball within the ball retention cavity 116 is repositioned or moved within the ball delivery element 34 until the ball outlet aperture 108 of the ball feed surface 106 is aligned with the ball feed member 36. The ball outlet aperture 108 is sized to allow the ball to pass through the aperture 108 when the aperture 108 is aligned with the cylindrical opening defined by the ball feed member 36. Once aligned, gravity causes the ball to exist the ball delivery element 34 through the aperture 108 and into the ball feed member 36 for delivery to the ball projecting machine 10 or other device.

Referring to FIGS. 2 and 3, the ball delivery element 34 is driven by the drive assembly 38. In one implementation, the drive assembly 38 is an electric motor operably coupled to the central shaft 100 to rotate the central shaft 100 at a speed of within the range of 1 to 16 rpm. In one particular implementation, the motor rotates the central shaft 100 at a speed of approximately 4 rpm. In other implementations, the drive assembly can drive the central shaft at other rotational speeds. In one particular implementation, at a rotational speed of 4 rpm, the ball delivery element 34 completes one revolution every 15 seconds and the ball receiving surface 102 defines two inlet apertures 104 spaced apart by approximately 180 degrees. Accordingly, the ball delivery element 34 delivers one ball to the ball feed member 36 through the outlet aperture 108 once every 7.5 seconds. In other implementations, other rotational speeds can be used and other configurations of the ball delivery element can be used including a different number in inlet apertures can be used to provide other ball feed rates.

Referring to FIGS. 1 through 3, the ball feed member 36 is a flexible tube that transfers the ball 12 from the ball delivery element 34 to the ball projecting machine 10 or other implement. The ball feed member 36 includes a first end 109 that is connected to the ball delivery element at the ball outlet aperture 108, and the second end which is preferably removably attachable to the ball projecting machine 10. The flexible configuration of the ball delivery element 34 enables it to accommodate for the position and relative movement of the ball projecting machine 10 relative to the ball feeder assembly 20. The ball 12 is fed through the ball feed member 36 by the force of gravity. Accordingly, the ball feed member 36 is sized, shaped and configured to minimize frictional resistance acting upon the ball. In other implementations, the ball feed member can be a rigid, non-flexible member. In another implementation, the ball feed member can be an open tray or track. In another implementation, the ball feed mechanism, can be two or more tubular members coupled together to route the ball to the desired location.

The electric motor of the drive assembly 38 can be powered through cord 120 to an offsite electric power source. An on/off switch 122 can be mounted to the drive assembly 38 for access by the user at the machine.

Referring to FIG. 7, in another implementation, the drive assembly 38 of the ball feed assembly 20 can be a battery powered motor that allows for automatic rotation of the ball delivery assembly in locations where convenient access to an electrical power grid is not available or practical. A battery 124 can be used to provide a power source to the drive assembly 38 for rotating the ball delivery element 34. In another implementation, the ball feeder assembly can be configured for manual rotation of the ball delivery element with or without an electric powered drive assembly.

In another implementation, the ball feeder assembly 20 can be removably attached to a soft toss mechanism 130. A second end 132 of the ball feed member 36 can be removably coupled to the soft toss mechanism 130. The soft toss mechanism 130 applies a force to the ball 12 at the second end 132 of the ball feed member 36 to project the ball 12 upward by a few feet to provide a slow tossed ball to the user for batting practice. The soft toss mechanism 130 can be adjustable to provide different levels of force to the ball and thereby provide soft tossed balls at different heights. In one implementation, the soft toss mechanism 130 includes a spring loaded lever 138 that projects the ball 12 upward. The soft toss mechanism 130 can be powered by an electric motor 140 which can be supplied by a battery (such as the battery 124) through a power cord 142. In one implementation, the battery 124 used to power the ball feeder assembly 20 can also be used to supply power to the soft toss mechanism 130. In other implementations, separate batteries can be used for each electric motor and/or power can be supplied from an offsite power grid through the cords to the motors.

Referring to FIG. 6, in one implementation a remote controller 150 can be removably attached to the power cord 120 of the drive assembly 38. The remote controller 150 can include a remote control unit 152 for remotely controlling the operation of the ball feed assembly 20. The remote controller 150 enables a user at a remote position from the ball feeder assembly 20 to operate the assembly 20. The remote controller 150 is essentially an electric switch that turns the power on and off to the drive assembly. The remote control unit 152 can be a wireless unit. In another implementation, the control unit can be wired to the remote controller.

Figure 10:
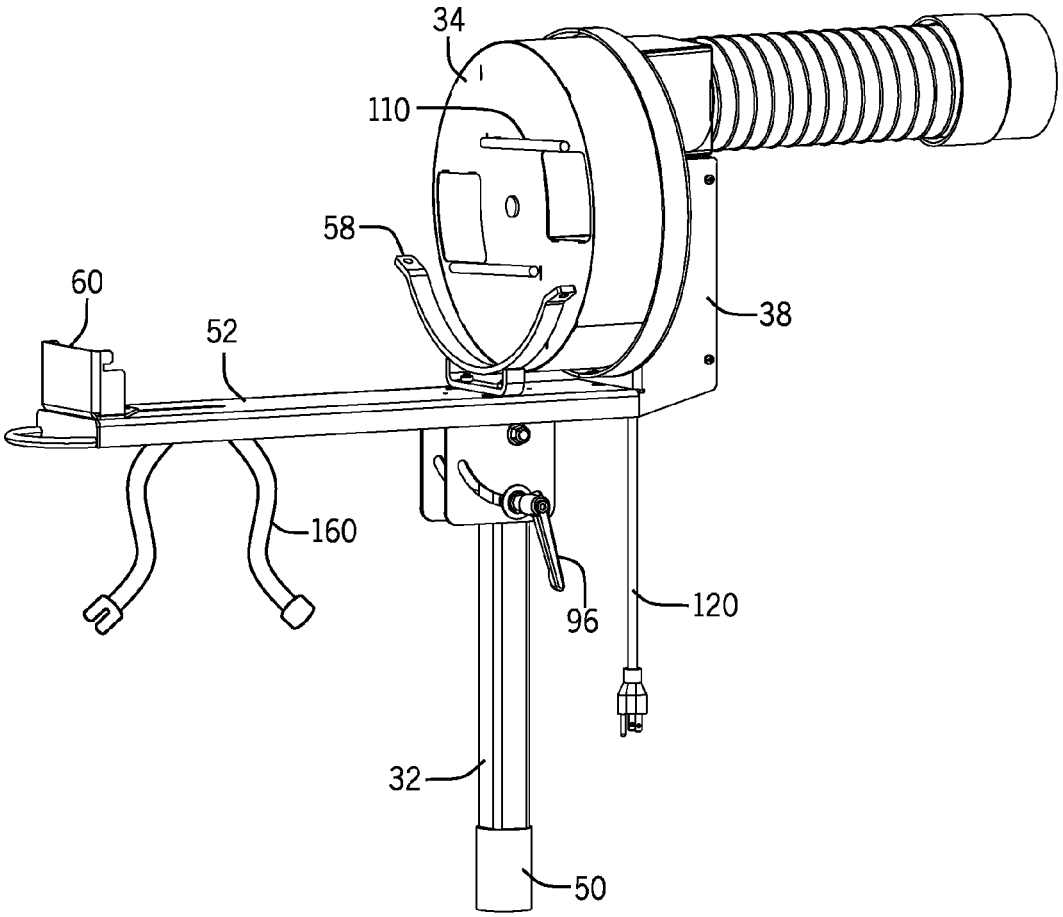
FIG. 10 is a side perspective view of the bucket ball feeder assembly shown without a bucket mounted to the assembly in accordance with an alternative preferred embodiment of the present invention.

Referring to FIG. 10, in other implementations of the ball feeder assembly 20, the support arm 52 can include a third fastener 160. In one implementation, the third fastener 160 can be a strap with a buckle for wrapping around the bucket to further secure the bucket to the support arm 52. In other implementations, other forms of fastening mechanisms can also be used in lieu of the first, second and third fasteners 58, 60 and 160. In other implementations, one fastening mechanism can be used, or other numbers of fastening mechanisms can be used to secure the bucket to the ball feeder assembly 22. In another implementation, the agitator 110 can take a curved shape. In other implementations, the number, size, shape and configuration of the agitator can be varied to produce the desired movement or agitation to the balls within the bucket during use of the ball feeder assembly 20.

The above-described features of the ball feeder assembly 20 provide a more efficient way to provide balls to a ball projecting machine. The ball feeder assembly 20 of the present invention enables a player, team or coach to easily load or feed practice balls into a pitching machine or ball projecting machine without having to load the pitching machine one ball at a time, or load a ball feed tray one ball at a time. The ball feeder assembly 20 is a ball feeding system that is simple, cost effective and works well with existing equipment of various types. The ball feeder assembly 20 is configured for use with professional grade pitching machines that project baseballs and softballs at speeds up to 100 mph, to soft toss mechanisms, to ball projecting machines of other sizes and outputs. The ball feeder assembly 20 provides a ball feeding system that is not too small or too large, and prevents the balls from being readily dislodged from the ball feeder.

While the preferred embodiments of the invention have been illustrated and described, it will be appreciated that various changes can be made therein without departing from the spirit and scope of the invention. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art.

Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A ball feeder assembly for a ball projecting machine, the ball feeder assembly configured for supporting a cylindrical bucket having upper and lower ends and at least a pair of annular projections adjacent the upper end, the bucket configured for holding a plurality of balls, the ball feeder assembly comprising:

a frame including a bucket support arm, the bucket support arm including first and second spaced-apart bucket supports, the first support being configured to removably engage the bucket between the pair of annular projections;

a ball delivery element supported by the frame;

a motor supported by the frame and operably coupled to the ball delivery element;

a stand coupled to the frame; and a ball feed member coupled to the ball delivery element, the ball feed member having a first end coupled to the ball feeder assembly and a second end removably coupled to the ball projecting machine.

2. The ball feeder assembly of claim 1, wherein the ball feed member is a flexible tube.

3. The ball feeder assembly of claim 1, wherein the second bucket support is configured to removably engage the lower end of the bucket.

4. The ball feeder assembly of claim 1, wherein the ball delivery element is a rotatable drum having a ball receiving surface defining at least one ball inlet aperture, and a ball feed surface defining at least one ball outlet aperture.

5. The ball feeder assembly of claim 4, wherein the motor is configured to rotate the drum at a speed within the range of 1 to 16 rpm.

6. The ball feeder assembly of claim 5, further including a remote wireless controller operably coupled to the motor.

7. The ball feeder assembly of claim 5, wherein the motor is battery operated, and wherein a battery is operably coupled to the motor.

8. The ball feeder assembly of claim 1, wherein the ball projecting machine is a soft toss mechanism removably coupled to the ball feed member.

9. A ball feeder assembly for a ball projecting machine, the ball feeder assembly configured for supporting a cylindrical ball bucket containing a plurality of balls, the bucket longitudinally extending from a closed bottom end to an open top end along a longitudinal axis, the ball feeder assembly comprising:

a stand;

an upper frame movably coupled to the stand between at least a first bucket loading position in which the upper frame is configured to support the bucket in a generally upright position with the upper top end at a higher elevation than the bottom end such that the longitudinal axis of the bucket is at angle within the range of between 0 and 80 degrees from a vertical plane, and a second ball feed position in which the upper frame is configured to support the bucket in a downward position with the bottom end at a higher elevation than the upper end such that the longitudinal axis is within the range of 5 to 90 degrees with respect to a horizontal plane;

a ball delivery element coupled to the frame; and a ball feed member coupled to the ball delivery element.

10. The ball feeder assembly of claim 9, wherein, when in the first bucket loading position, the longitudinal axis of the bucket is at angle within the range of between 0 and 45 degrees from the vertical plane.

11. The ball feeder assembly of claim 9, wherein, when in the second ball feed position, the longitudinal axis of the bucket is at angle within the range of 10 to 60 degrees with respect to a horizontal plane.

12. The ball feeder assembly of claim 9, wherein the ball delivery element is a rotatable drum having a ball receiving surface defining at least one ball inlet aperture, and a ball feed surface defining at least one ball outlet aperture.

13. The ball feeder assembly of claim 12, wherein the ball receiving surface includes at least one projection configured for agitating the balls in the bucket.

14. The ball feeder assembly of claim 9, further comprising first and second adjustment mechanisms coupled to at least one of the stand and the upper frame, wherein the first and second adjustment mechanisms include first and second adjusting elements that, when repositioned, incrementally rotate the upper frame about first and second pivot axes, respectively, and wherein first axis is orthogonal to the second axis.

15. The ball feeder assembly of claim 9, wherein the ball delivery element is configured to deliver the balls to the ball feed element at a rate within the range of one ball every 5 seconds to one ball every 20 seconds.

16. A ball feeder assembly configured to deliver a plurality of balls to a ball projecting machine, the ball feeder assembly comprising:

a stand;

an upper frame movably coupled to the stand;

a first adjustment mechanism coupled to at least one of the stand and the upper frame, the first adjustment mechanism including a first adjusting element that, when repositioned, incrementally rotates the upper frame about a first pivot axis;

a cylindrical ball bucket removably coupled to the upper frame, the bucket longitudinally extending from a closed bottom end to an open top end along a longitudinal axis;

a ball delivery element including a ball receiving surface defining at least one ball inlet aperture, and a ball feed surface defining at least one ball outlet aperture; and a ball feed member coupled to the ball delivery element.

17. The ball feeder assembly of claim 16, further comprising a second adjustment mechanism coupled to at least one of the stand and the upper frame, wherein the second adjustment mechanism includes a second adjusting element that, when repositioned, incrementally rotates the upper frame about the second pivot axis, and wherein first axis is orthogonal to the second axis.

18. The ball feeder assembly of claim 16, wherein the ball bucket is sized to retain up to 60 balls.

19. The ball feeder assembly of claim 18, wherein the ball feed member is a flexible feeder tube having a first end coupled to the ball delivery element, and a second end removably coupled to the ball projecting machine.

20. The ball feeder assembly of claim 18, wherein the upper frame includes a bucket support arm, and wherein the bucket support arm includes first and second spaced apart bucket supports.

21. The ball feeder assembly of claim 20, wherein the bucket includes at least two spaced apart annular projections positioned adjacent the open top end, and wherein the first bucket support is a cradle bracket that engages the bucket between the annular projections.

22. The ball feeder of claim 16, wherein the upper frame movably coupled to the stand between at least a first bucket loading position in which the upper frame is configured to support the bucket in a generally upright position with the top end at a higher elevation than the bottom end such that the longitudinal axis of the bucket is at a first angle within the range of between 0 and 80 degrees from a vertical plane, and a second ball feed position in which the upper frame is configured to support the bucket in a downward position with the bottom end at a higher elevation than the upper end such that the longitudinal axis is at a second angle within the range of 5 to 90 degrees with respect to a horizontal plane.

* * * * *